US010199020B1

(12) United States Patent
Chen

(10) Patent No.: US 10,199,020 B1
(45) Date of Patent: Feb. 5, 2019

(54) DRUM PRACTICE APPARATUS

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 15/670,069

(22) Filed: Aug. 7, 2017

(51) Int. Cl.
*G10D 13/02* (2006.01)

(52) U.S. Cl.
CPC ..... *G10D 13/029* (2013.01)

(58) Field of Classification Search
CPC ..... G19D 13/029; G10D 13/02
See application file for complete search history.

(56) References Cited

U.S. PATENT DOCUMENTS 2,837,002 A * 6/1958 Susser ..... A61M 5/00 84/170
3,592,097 A * 7/1971 Friede ..... G10D 13/003 84/402
4,244,267 A * 1/1981 Nemeth ..... G10D 13/06 84/418
4,402,248 A * 9/1983 Pearce ..... G10D 13/02 84/411 R
5,962,798 A * 10/1999 Meinl ..... G10D 13/02 84/411 R
6,239,340 B1 * 5/2001 Heuerman ..... G10D 13/029 84/402
6,284,959 B1 * 9/2001 Nicolosi ..... G10D 13/029 84/411 P
7,692,083 B2 * 4/2010 Aspland ..... G10D 13/006 84/411 R
8,829,321 B2 * 9/2014 Klein ..... G10D 13/02 84/411 R
8,912,417 B2 * 12/2014 Krol ..... G10D 13/02 84/418
9,087,497 B1 * 7/2015 Krol ..... G10D 13/02
9,466,273 B2 * 10/2016 Krol ..... G10D 13/025
9,779,707 B2 * 10/2017 Turner ..... G10D 13/028
2002/0092406 A1 * 7/2002 Hagiwara ..... G10D 13/02 84/411 R
2017/0047052 A1 * 2/2017 Martinelli ..... G10D 13/027
2018/0082666 A1 * 3/2018 Wunderlich ..... G10D 13/02

FOREIGN PATENT DOCUMENTS

TW M346086 U 12/2008

* cited by examiner

*Primary Examiner* — Robert W Horn
(74) *Attorney, Agent, or Firm* — Muncy, Geissler, Olds & Lowe, P.C.

(57) ABSTRACT

A drum practice apparatus is provided, including: a main body, including a base and a striking portion, the striking portion disposed on a side of the base; at least one sounding assembly, each sounding assembly including a connection member and at least one sounding member, the connection member being connected with the at least one sounding member and another side of the base opposite to the striking portion, at least one said sounding member being freely movable relative to the connection member.

7 Claims, 4 Drawing Sheets

DRUM PRACTICE APPARATUS

BACKGROUND OF THE INVENTION

Field of the Invention

The present invention relates to a drum practice apparatus.

Description of the Prior Art

Generally, a beginner of practicing drum starts from a drum practice apparatus. The conventional drum practice apparatus has a striking portion made of elastic rubber or plastic material, and it makes low and unclear sound. The low and unclear sound results in that the instructor is hard to be conscious of deficiency and shortcoming of the drummer or fault of rhythm. Besides, the drummer cannot get real performance experience so that the practicing effect is not good. Therefore, a drum practice apparatus such as that disclosed in TWM346086 is provided, in which a plurality of ball members are disposed between the bottom board and the top board so that the ball members can collide with the bottom board and the top board to sound when the striking portion is stricken to vibrate.

However, the above-mentioned conventional drum practice apparatus is provided with the ball members disposed thereinside, so the sound cannot be transmitted and distributed well and broadly. Furthermore, to install or uninstall the ball members, the bottom board and the top board have to be detached from each other using tools to remove, thus being complicated to assemble/disassemble.

The present invention is, therefore, arisen to obviate or at least mitigate the above mentioned disadvantages.

SUMMARY OF THE INVENTION

The main object of the present invention is to provide a drum practice apparatus, which provides sonorous sound to the drummer and the instructor, and real performance feeling, and is easy to assemble/disassemble.

To achieve the above and other objects, a drum practice apparatus is provided, including: a main body, including a base and a striking portion, the striking portion disposed on a side of the base; at least one sounding assembly, each sounding assembly including a connection member and at least one sounding member, the connection member being connected with the at least one sounding member and another side of the base opposite to the striking portion, at least one said sounding member being freely movable relative to the connection member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
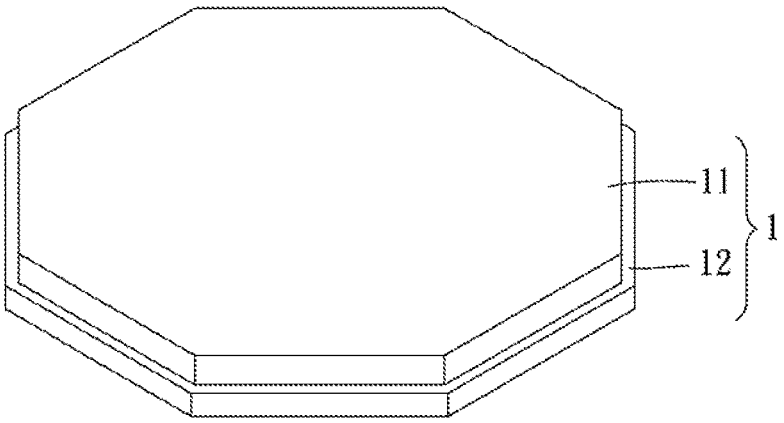
FIG. 1 is a perspective view of a preferred embodiment of the present invention.
Figure 2:
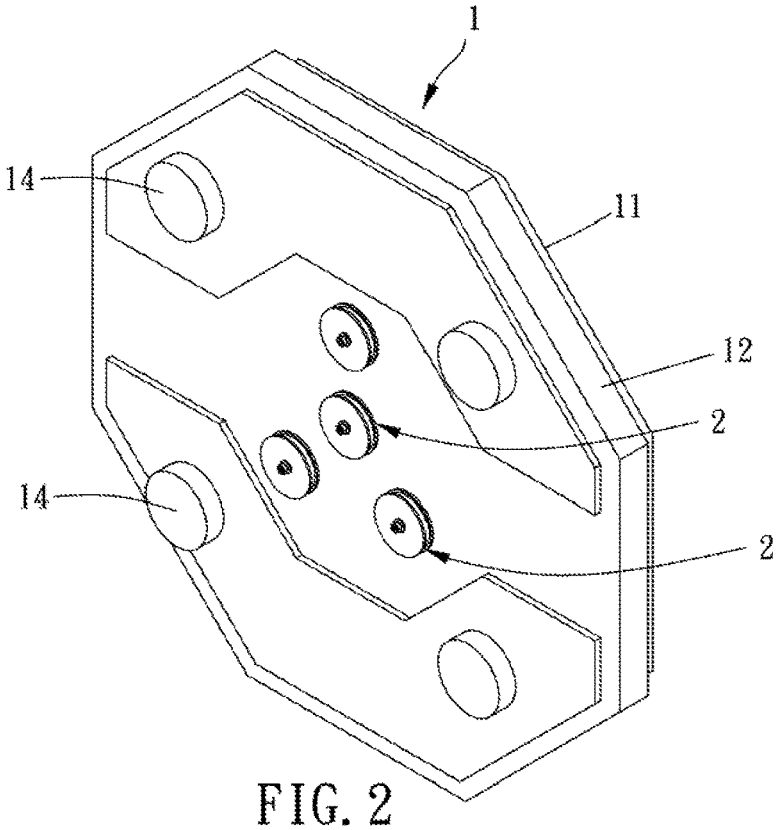
FIG. 2 is another perspective view of the preferred embodiment of the present invention.
Figure 3:
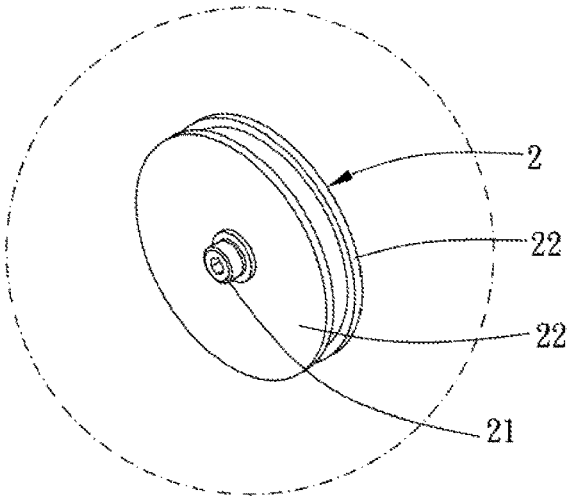
FIG. 3 is a partially-enlarged drawing of FIG. 2.
Figure 4:
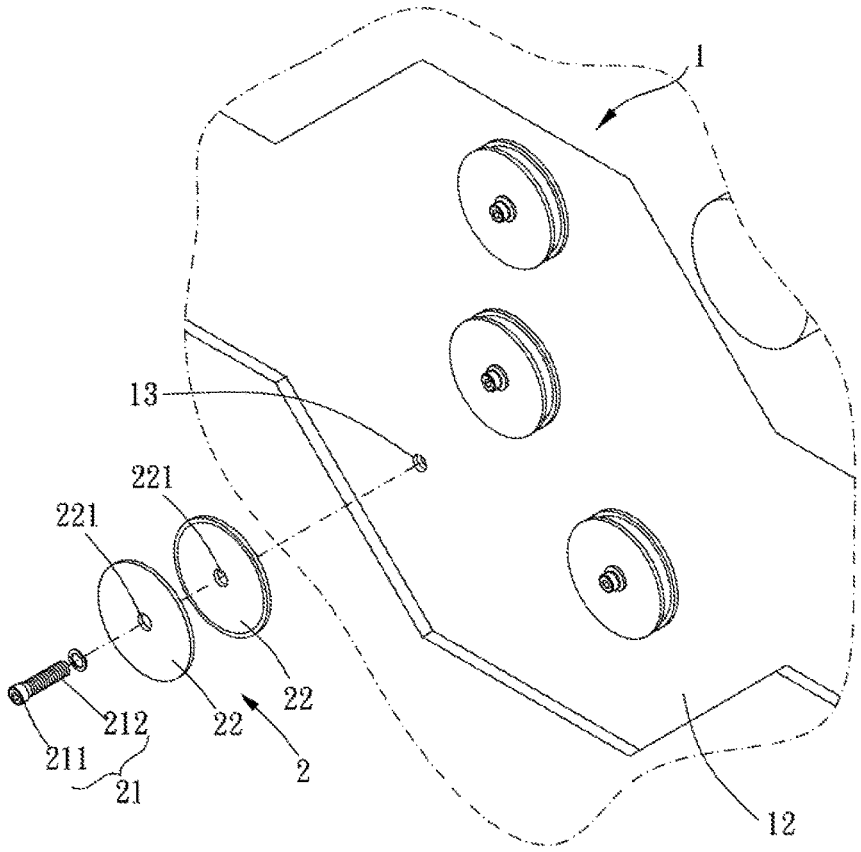
FIG. 4 is a breakdown drawing of the preferred embodiment of the present invention.
Figure 5:
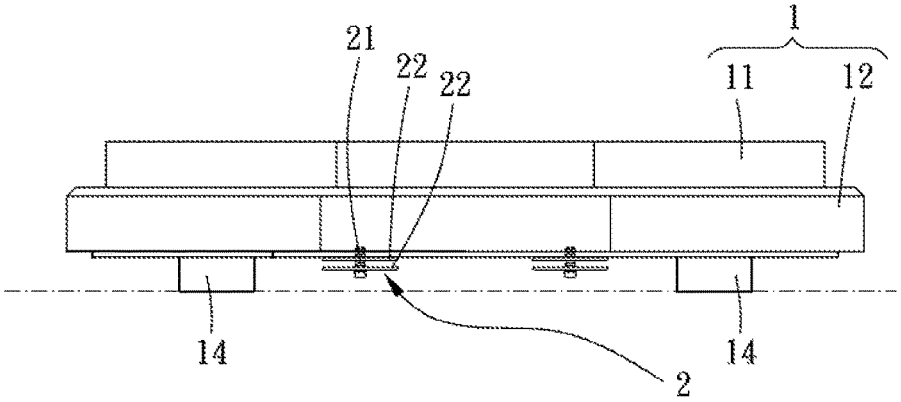
FIG. 5 is a side view of the preferred embodiment of the present invention.
Figure 6:
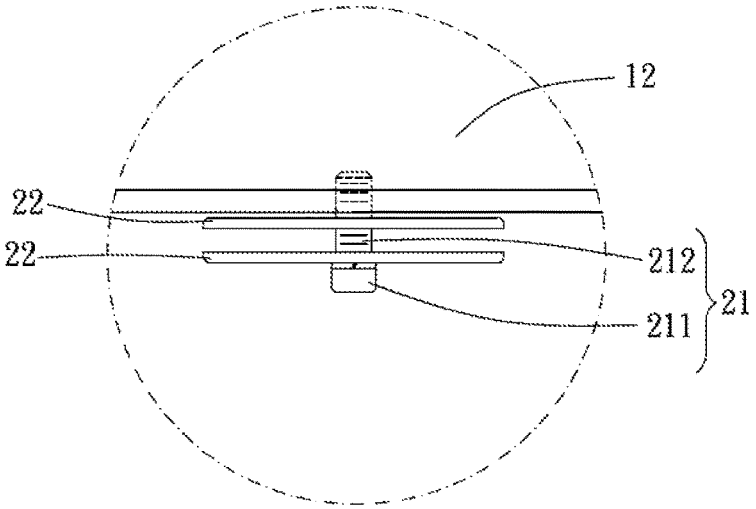
FIG. 6 is a partially-enlarged drawing of FIG. 5.

As shown in FIGS. 1 to 6, a drum practice apparatus of a preferred embodiment according to the present invention is provided. The drum practice apparatus includes a main body 1 and at least one sounding assembly 2.

The main body 1 includes a base 12 and a striking portion 11, and the striking portion 11 is disposed on a side of the base 12.

Each sounding assembly 2 includes a connection member 21 and at least one sounding member 22, In this embodiment, the drum practice apparatus includes four sounding assemblies 2, and each sounding assembly 2 includes two sounding members 22. The connection member 21 is connected with the at least one sounding member 22 and another side of the base 12 opposite to the striking portion 11. At least one of the sounding members 22 is freely movable relative to the connection member 21. Preferably, a distance between the two of the sounding members 22 is less than ⅓ of a radial dimension of the sounding member 22. When the striking portion 11 is stricken and the base 12 of the main body 1 vibrates, at least one of the sounding members 22 moves relative to the connection member 21 and collides with other sounding member22, the connection member 21 or/and the base 12 so as to sound.

Specifically, because the connection member 21 is connected with a side of the main body 1 opposite to the striking portion 11, the striking force and energy can be sufficiently transmitted to the connection member 21 and the sounding members 22. In this embodiment, the base 12 and the striking portion 11 are two individuals, the striking portion 11 is made of relatively soft material such as rubber or thick cloth, and the base 12 is a relatively rigid plate such as a plastic plate or wood plate. The striking portion 11 is disposed on a side of the base 12, and the connection member 21 is connected with the base 12; that is, the connection member 21 is connected with the sounding members 22 and another side of the base 12 opposite to the striking portion 11. When the striking portion 11 is stricken and the base 12 of the main body 1 vibrates, at least one the sounding members 22 moves relative to the connection member 21 and collides with other sounding member22, the connection member 21 or/and the base 12 so as to sound. In this embodiment, each sounding assembly includes two of the sounding members 22, and one of the two of the sounding members 22 is fixedly connected to the main body 1 and the other is freely movable relative to. As a result, when the sounding member 22 which is movable moves and collide with the sounding member 22 which is fixed, the base 12 and/or the connection member 21, it makes sound, so that it provides sonorous sound to the drummer and the instructor, and real performance feeling. Preferably, each sounding member 22 is a metal plate or a plastic plate, which can provide pleasing, loud and clear sound.

Specifically, each sounding member 22 includes a through hole 221, an end of the connection member 21 includes an enlarged head portion 211, and the enlarged head portion 211 is greater than the through hole 221 of the sounding member 22 in radial dimension. The connection member 21 is disposed through the through hole 221, and an end of the connection member 21 far away from the enlarged head portion 211 is connected with the main body 1. As a result, the enlarged head portion 211 can prevent the sounding members 22 from disengaging from the connection member 21.

In this embodiment, the connection member 21 includes an external threaded portion 212, the main body 1 includes a threaded hole 13, and the external threaded portion 212 is screwed to the threaded hole 13, thus facilitating assembling/disassembling the connection member 21. The connection member 21 is therefore detachable for changing the number of the sounding member 22 according various requirements of sound volume or tone.

In this embodiment, the another side of the base 12 opposite to the striking portion 11 includes at least one slip-proof pad 14, and relative to the another side of the base 12 opposite to the striking portion 11. The at least one slip-proof pad 14 is, preferably, more protrusive than each sounding assembly 2, which provides s space for operation of each sounding assembly 2 to sound.

Given the above, the drum practice apparatus provides sonorous sound to the drummer and the instructor, and real performance feeling, and is easy to assemble/disassemble.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A drum practice apparatus, including:

a main body, including a base and a striking portion, the striking portion disposed on a side of the base;

at least one sounding assembly, each sounding assembly including a connection member and at least one sounding member, the connection member being connected with the at least one sounding member and another side of the base opposite to the striking portion, at least one said sounding member being freely movable relative to the connection member; wherein the at least one sounding assembly includes two of the sounding members which are disks and contactable with each other, at least one said sounding member includes a through hole through which the connection member is disposed, a distance between the two of the sounding members is less than ⅓ of a diametric dimension of the sounding member; wherein the two of the sounding members produce sound when an impact between the two of the sounding members occurs as practice is carried out on the drum practice apparatus;

wherein the at least one said sounding member including the through hole is freely movable along the connection member within the distance between the two of the sounding members.

2. The drum practice apparatus of claim 1, wherein each sounding member includes one said through hole, an end of the connection member includes an enlarged head portion, the enlarged head portion is greater than the through hole of the sounding member in radial dimension, the connection member is disposed through the through hole, and an end of the connection member far away from the enlarged head portion is connected with the main body.

3. The drum practice apparatus of claim 1, wherein the connection member includes an external threaded portion, the main body further includes a threaded hole, and the external threaded portion is screwed to the threaded hole.

4. The drum practice apparatus of claim 1, wherein the at least one sounding assembly includes two of the sounding members, and one of the two of the sounding members is fixedly connected to the main body.

5. The drum practice apparatus of claim 1, wherein each sounding member is a metal plate or a plastic plate.

6. The drum practice apparatus of claim 1, wherein the another side of the base opposite to the striking portion the base includes at least one slip-proof pad, and relative to the another side of the base opposite to the striking portion the base, the at least one slip-proof pad is more protrusive than each sounding assembly.

7. The drum practice apparatus of claim 1, wherein each sounding member includes one said through hole, an end of the connection member includes an enlarged head portion, the enlarged head portion is greater than the through hole of the sounding member in radial dimension, the connection member is disposed through the through hole, and an end of the connection member far away from the enlarged head portion is connected with the main body; the connection member includes an external threaded portion, the main body further includes a threaded hole, the external threaded portion is screwed to the threaded hole; one of the two of the sounding members is fixedly connected to the main body; each sounding member is a metal plate or a plastic plate; the another side of the base opposite to the striking portion the base includes at least one slip-proof pad, and relative to the another side of the base opposite to the striking portion the base, the at least one slip-proof pad is more protrusive than each sounding assembly.

* * * * *